United States Patent [19]

Bouwknegt et al.

[11] Patent Number: 5,069,681

[45] Date of Patent: Dec. 3, 1991

[54] PROCESS FOR THE PHOTOCHEMICAL STABILIZATION OF DYED POLYAMIDE FIBRES WITH FOAMED AQUEOUS COMPOSITION OF COPPER ORGANIC COMPLEXES

[75] Inventors: Thys Bouwknegt, Reinach, Switzerland; Claude Dietz, St. Louis-la-Chaussée, France

[73] Assignee: Ciba-Geigy Corporation, Ardsley, N.Y.

[21] Appl. No.: 633,832

[22] Filed: Dec. 26, 1990

[30] Foreign Application Priority Data

Jan. 3, 1990 [CH] Switzerland ..... 10/90

[51] Int. Cl.[5] ..... D06P 5/02

[52] U.S. Cl. ..... 8/442; 8/477; 8/575; 8/602; 8/607; 8/608; 8/624; 8/924

[58] Field of Search ..... 8/442, 477

[56] References Cited

U.S. PATENT DOCUMENTS

| | | | |
|---|---|---|---|
| 4,408,995 | 10/1983 | Guth et al. | 8/477 |
| 4,413,998 | 11/1983 | Guth et al. | 8/477 |
| 4,428,751 | 1/1984 | Via | 8/477 |
| 4,655,783 | 4/1987 | Reinert et al. | 8/115.66 |
| 4,655,785 | 4/1987 | Reinert et al. | 8/442 |
| 4,704,133 | 11/1987 | Reinert et al. | 8/442 |
| 4,775,386 | 10/1988 | Reinert et al. | 8/442 |
| 4,874,391 | 10/1989 | Reinert | 8/442 |
| 4,990,164 | 2/1991 | Huber-Emden et al. | 8/442 |

*Primary Examiner*—A. Lionel Clingman

*Attorney, Agent, or Firm*—George R. Dohmann; Edward McC. Roberts

[57] ABSTRACT

There is disclosed a process for the photochemical stabilization of dyed polyamide fibre materials, which comprises treating the dyed material with an aqueous foamed composition which contains at least a non-dyeing copper complex of bisazomethines, acylhydrazones, semicarbazones or thiosemicarbazones of aromatic aldehydes or ketones or oximes.

By means of the process of this invention it is possible to prevent wastewater from being contaminated with copper-containing impurities.

24 Claims, No Drawings

PROCESS FOR THE PHOTOCHEMICAL STABILIZATION OF DYED POLYAMIDE FIBRES WITH FOAMED AQUEOUS COMPOSITION OF COPPER ORGANIC COMPLEXES

The present invention relates to a process for the photochemical stabilisation of dyed polyamide fibre materials, preferably of marked three-dimensional character (pile materials) and, in particular, carpets with the aid of foam, to an aqueous composition for carrying out said process, and to the textile material treated by said process.

The use of copper complexes of bisazomethines for enhancing the lightfastness of dyeings on polyamide fabric is taught in U.S. Pat. No. 4,655,783, which copper complexes are applied in the dyebath. This process results unavoidably in waste liquors which are contaminated with copper.

Surprisingly, it has proved possible to prevent these contaminated waste liquors by applying these copper complexes to the dyed textile material in an aftertreatment by means of an foamed aqueous composition.

Specifically, the invention relates to a process for the photochemical stabilisation of dyed polyamide fibre materials, which comprises treating the dyed material with a foamed aqueous composition which contains at least (a) a non-dyeing copper complex of bisazomethines, acylhydrazones, semicarbazones or thiosemicarbazones of aromatic aldehydes or ketones or oximes.

Bisazomethines of aromatic aldehydes or ketones are here understood to means Schiff base of aliphatic or aromatic diamines, the aldehydes and ketones having an OH group in the o-position to the formyl or acetyl radical. They are bonded to the metal atom via these two OH groups and the two nitrogen atoms in the bisazomethine moiety. Accordingly, these are quadridentate ligands, which can contain one or more sulfo groups which are located in the aldehyde or ketone moiety and/or in the bisazomethine bridge.

The component (a) used is preferably a copper complex of the formula

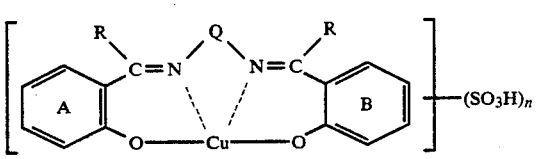

(1)

in which R is hydrogen or a substituted or unsubstituted alkyl or aryl radical, Q is a substituted or unsubstituted alkylene, cycloalkylene or arylene radical and n is 0, 1, 2 or 3.

The benzene ring A and B can also be substituted, and in particular independently of one another.

A substituted or unsubstituted alkyl radical R can preferably be a $C_1$–$C_8$alkyl radical, especially a $C_1$–$C_4$alkyl radical, which can be branched or unbranched and can be unsubstituted or substituted, namely by halogen such as fluorine, chlorine or bromine, $C_1$–$C_4$alkoxy such as methoxy or ethoxy, by a phenyl or carboxyl radical, by $C_1$–$C_4$alkoxycarbonyl, for example the acetyl radical, or by hydroxyl or a mono- or di-alkylated amino group. Furthermore, a cyclohexyl radical is also possible, which can likewise be substituted, for example by $C_1$–$C_4$alkyl or $C_1$–$C_4$alkoxy.

A substituted or unsubstituted aryl radical R can especially be a phenyl or naphthyl radical which can be substituted by $C_1$–$C_4$alkyl such as methyl, ethyl, propyl, isopropyl, butyl, isobutyl, sec.butyl and tert.butyl, $C_1$–$C_4$alkoxy such as methoxy, ethoxy, propoxy, isopropoxy, butoxy, isobutoxy, sec.butoxy and tert.butoxy, halogen such as fluorine, chlorine or bromine, $C_2$–$C_5$alkanoylamino such as acetylamino, propionylamino or butyrylamino, nitro, cyano, sulfo or a mono- or di-alkylated amino group.

An alkylene radical Q is especially a substituted or unsubstituted $C_2$–$C_4$alkylene radical, in particular a —$CH_2$—$CH_2$ bridge. However, this can also be a $C_2$–$C_8$alkylene chain interrupted by oxygen or especially by nitrogen, and in particular a —$(CH_2)_3$—NH—$(CH_2)_3$— bridge.

An arylene radical Q is especially a phenylene radical, in particular an o-phenylene radical. This can be substituted by $C_1$–$C_4$alkyl or $C_1$–$C_4$alkoxy.

A cycloalkylene radical Q is a cycloaliphatic radical of 5–7 carbon atoms, such as cyclopentylene, cyclohexylene or cycloheptylene.

Possible substituents for the benzene rings A and B are: halogen such as fluorine, chlorine or bromine, the cyano or nitro group, alkyl, alkoxy, hydroxyl, hydroxyalkyl, alkoxyalkoxy, alkoxyalkoxyalkoxy, carboxymethoxy, alkylamino, dialkylamino, —$SO_2NH_2$, —$SO_2NHR_0$ or —$SO_2N(R_0)_2$, $R_0$ being alkyl or alkoxyalkyl, and alkyl and alkoxy each being understood as radicals having 1–4 carbon atoms, or a benzene radical formed by radicals in the mutual ortho-positions, together with the carbon atoms to which they are linked.

The sulfo group(s) in the benzene rings A and/or B and/or in the bridge member Q, if the latter is an arylene radical, is (are) preferably in the form of an alkali metal salt, especially as the sodium or as an amine salt.

Amongst the copper complexes of formula (1) particular importance is attached to the bisazomethine complexes of the formula

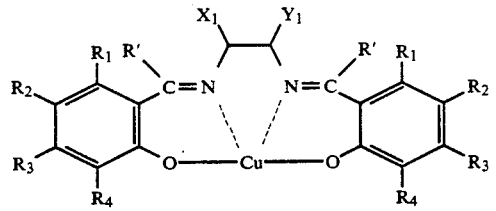

(2)

in which R' is hydrogen, $R_1$, $R_2$, $R_3$ and $R_4$ are each hydrogen, halogen, hydroxyl, hydroxyalkyl, alkyl, alkoxy, alkoxyalkoxy, alkoxyalkoxyalkoxy, carboxymethoxy, alkylamino, dialkylamino, —$SO_2NH_2$, —$SO_2NHR_0$ or —$SO_2N(R_0)_2$, $R_0$ being alkyl or alkoxyalkyl, and alkyl or alkoxy each being understood as groups having 1–4 carbon atoms, or $R_1$ and $R_2$ or $R_2$ and $R_3$ or $R_3$ and $R_4$, together with the carbon atoms to which they are linked, form a benzene radical, and $X_1$ and $Y_1$ are hydrogen, $C_1$–$C_4$alkyl or an aromatic radical or $X_1$ and $Y_1$ form together with the carbon atom to which they are linked a cycloaliphatic radical of 5–7 carbon atoms.

$X_1$ and $X_2$ in the meaning of $C_1$–$C_4$alkyl are for example methyl, ethyl, n-propyl, isopropyl, n-butyl, isobutyl, sec.butyl and tert.butyl. Aromatic radicals for $X_1$ and $Y_1$ are in particular substituted or not substituted naphthyl and most particular phenyl radicals.

The cycloaliphatic radicals are cyclopentylene, cyclohexylene or cycloheptylene radicals.

The copper complex compounds of formula (2) are normally water-insoluble, provided they contain no carboxymethoxy radicals (—O—$CH_2$—COOH) or salts thereof.

Preferably $R_1$ to $R_4$ are each independently of the other hydrogen, chloro, bromo, methyl, ethyl, butyl, methoxy, ethoxy, methoxyethoxy, ethoxyethoxyethoxy or diethylamino, or $R_1$ and $R_2$ together form a fused benzene ring.

One of the substituents $X_1$ and $Y_1$ is preferably hydrogen and the other is hydrogen, methyl, ethyl or phenyl, or $X_1$ and $Y_1$ together form a cyclohexylene radical.

Preferably water-insoluble copper complex compounds of the formula

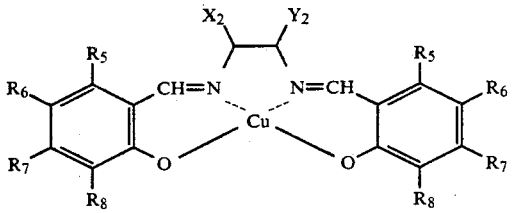

(3)

are used wherein $R_5$–$R_8$ are each and independently from each other hydrogen, hydroxyl, chlorine, bromine, methyl, tert.butyl, methoxy, methoxyethoxy, ethoxyethoxyethoxy or diethylamino, $X_2$ hydrogen, methyl, ethyl or phenyl and $Y_2$ hydrogen or $R_5$ and $R_6$ together form a fused benzene ring or $X_2$ and $Y_2$ together form a cyclohexylene radical.

Of particular interest are compounds of the formula

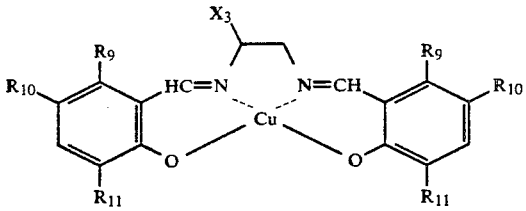

(4)

wherein $R_9$, $R_{10}$ and $R_{11}$ are each independently of one another hydrogen, chloro, bromo, methyl or methoxy, or wherein $R_9$ and $R_{10}$ together form a fused benzene ring, and $X_3$ is hydrogen, methyl, ethyl or phenyl.

Particularly preferred, however, are compounds of formula (4), wherein $R_9$, $R_{10}$, $R_{11}$ and $X_3$ are hydrogen.

Copper complexes of acylhydrazones of aromatic aldehydes and ketones as component (a) are especially the complex compounds of formula

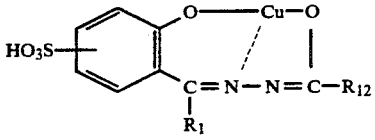

(5)

in which $R_1$ and $R_{12}$ independently of one another are hydrogen or a substituted or unsubstituted alkyl or aryl radical, and copper complexes of semicarbazones or thiosemicarbazones as the component (a) are especially the complexes of the formula

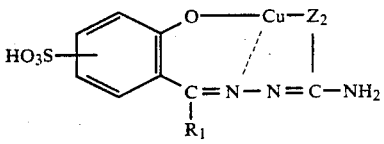

(5a)

in which $R_1$ is as defined in formula (5) and $Z_2$ is oxygen or sulfur.

The alkyl radical $R_1$ and/or $R_{12}$ in the formulae (5) and (5*a*) can be branched or unbranched and has a chain length of preferably 1 to 8 and especially 1 to 4 carbon atoms. Possible substituents are halogen such as fluorine, chlorine or bromine, $C_1$–$C_4$alkoxy such as methoxy or ethoxy, and also phenyl or carboxyl, $C_1$–$C_4$alkoxycarbonyl, for example acetyl, or hydroxyl and mono- or dialkylamino.

A substituted or unsubstituted aryl radical $R_1$ and/or $R_{12}$ in the formulae (5) and (5*a*) can especially be a phenyl or naphthyl radical which can be substituted by $C_1$–$C_4$alkyl such as methyl, ethyl, propyl, isopropyl, butyl, isobutyl, sec.butyl or tert.butyl, $C_1$–$C_4$alkoxy such as methoxy, ethoxy, propoxy, isopropoxy, butoxy, isobutoxy, sec.butoxy or tert.butoxy, halogen such as fluorine, chlorine or bromine, $C_2$–$C_5$alkanoylamino such as acetylamino, propionylamino or butyrylamino, nitro, cyano, sulfo or a mono- or di-alkylated amino group.

Those complexes of the formula (5) are preferably used in which $R_1$ is hydrogen and $R_{12}$ is hydrogen, methyl or especially a phenyl radical, and particularly the complexes in which the sulfo group in turn is in the p-position to the oxygen.

Copper complexes of oximes as component (a) are mainly copper compounds of phenols of the formula

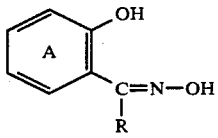

(6)

wherein R is hydrogen, hydroxy, alkyl or cycloalkyl, and in which the ring A can be substituted or further substituted, for example copper compounds of salicylaldoxime and salicylhydroxamic acid.

Suitable alkyl radicals are those having 1 to 4 carbon atoms, suitable cycloalkyl radicals cyclohexyl and methylcyclohexyl radicals, suitable substituents in the ring A are methyl, methoxy or chlorine. However, this ring is preferably unsubstituted.

The complexes of the formulae (1) to (5) are preferably used in the neutral form, viz. as an alkali metal salt, in particular the sodium salt, or an amine salt.

The compounds which can be used as component (a) are known and can be prepared by processes known per se. They are known for example from EP-A51 188, 113 856 and 162 811 can be prepared by known processes.

The compounds which can be used as component (a) are conveniently applied from an aqueous bath, preferably in an amount such that 5 to 200 μg, preferably 10 to 100 μg, of copper are applied per 1 g of polyamide fibre material.

If the compounds of formula (1) are not water soluble they are conveniently used as fine dispersions which are obtained by milling in the presence of customary dispersants.

The foamed aqueous composition comprises, in addition to component (a), (b) an anionic surfactant or a nonionic surfactant or a mixture of such surfactants, and, as optional components, (c) a salt of a hydrolysed polymaleic anhydride, and (d) a polar organic solvent.

Component (b) of the composition of this invention is the actual foaming agent. Suitable for use as component (b) are anionic or nonionic surfactants or mixtures of anionic and nonionic surfactants.

The anionic surfactants of component (b) are preferably polyadducts of alkylene oxide, for example polyadducts of alkylene oxides, preferably of ethylene oxide and/or propylene oxide or also styrene oxide, with organic hydroxyl, carboxyl, amino and/or amido compounds or mixtures thereof containing aliphatic hydrocarbon radicals having a total of at least two carbon atoms, which adducts contain acid ether groups or, preferably, acid ester groups of inorganic or organic acids. These acid ethers or esters may be in the form of free acids or of salts, for example alkali metal salts, alkaline earth metal salts, ammonium salts or amine salts.

These anionic surfactants are prepared by known methods by addition of at least 1 mol, preferably of more than 1 mol, typically 2 to 60 mol, of ethylene oxide or propylene oxide or, alternately in any order, ethylene oxide and propylene oxide, to the above organic compounds, and subsequently esterifying the adducts, and, if desired, converting the esters into their salts. Suitable starting materials are, for example, higher fatty alcohols, i.e. alkanols or alkenols, each containing 8 to 22 carbon atoms, dihydric to hexahydric alcohols containing 2 to 9 carbon atoms, alicyclic alcohols, phenylphenols, benzylphenols, alkylphenols containing one or more alkyl substituents which together contain at least 4 carbon atoms, fatty acids containing 8 to 22 carbon atoms, amines which contain aliphatic and/or cycloaliphatic hydrocarbon radicals of at least 8 carbon atoms, preferably fatty amines which contain such radicals, hydroxyalkylamines, hydroxyalkylamides and aminoalkyl esters of fatty acids or dicarboxylic acids and higher alkylated aryloxycarboxylic acids.

Illustrative examples of suitable anionic surfactants are:

sulfated aliphatic alcohols containing 8 to 18 carbon atoms in the alkyl chain, for example sulfated lauryl alcohol;

sulfated unsaturated fatty acids or lower alkyl esters of fatty acids which contain 8 to 20 carbon atoms, for example ricinolic acid and oils containing such fatty acids, for example castor oil;

alkylsulfonates containing 8 to 20 carbon atoms in the alkyl chain, for example dodecylsulfonate;

alkylarylsulfonates having a straight or branched alkyl chain containing at least 6 carbon atoms, for example dodecylbenzenesulfonates or 3,7-diisobutylnaphthalenesulfonates;

the alkali metal salts, ammonium salts or amine salts of fatty acids of 10 to 20 carbon atoms referred to as soaps, for example colophonium salts;

esters of polyalcohols, preferably mono- or diglycerides of fatty acids containing 12 to 18 carbon atoms, for example monoglycerides of lauric, stearic or oleic acid, and the polyadducts of 1 to 60 mol of ethylene oxide and/or propylene oxide with fatty amines, fatty acids or fatty alcohols, each containing 8 to 22 carbon atoms, with alkylphenols containing 4 to 16 carbon atoms in the alkyl chain, or with trihydric to hexahydric alcohols containing 3 to 6 carbon atoms, which polyadducts are converted into an acid ester with an organic dicarboxylic acid such as maleic acid, malonic acid or sulfosuccinic acid, but preferably with an inorganic polybasic acid such as o-phosphoric acid or, more particularly, sulfuric acid.

Anionic surfactants very suitable for use as component (b) are:

(I) acid esters, or their salts, of a polyadduct of 2 to 15 mol of ethylene oxide with 1 mol of a fatty alcohol containing 8 to 22 carbon atoms or with 1 mol of an alkylphenol containing 4 to 12 carbon atoms in the alkyl moiety, (II) alkylphenylsulfonates containing 8 to 18 carbon atoms in the alkyl moiety, (III) sulfonated 1-benzyl-2-alkylbenzimidazoles containing 8 to 22 carbon atoms in the alkyl moiety, which components (I), (II) and (III) may be used singly or in admixture.

Component (I) of above preferred anionic surfactants can be represented, for example, by the formula

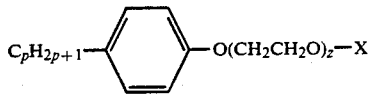

(7)

or by the formula $$R—O—(CH_2CH_2—O)_z—X \quad (8)$$

wherein R is alkyl or alkenyl, each of 8 to 22 carbon atoms, X is the acid radical of an inorganic, oxygen-containing acid or the radical of an inorganic acid, p is 4 to 12 and z is 2 to 15.

The alkyl radicals at the benzene ring of formula (7) may be butyl, hexyl, n-octyl, n-nonyl, p-tert-octyl, p-tert.nonyl, decyl or dodecyl. Alkyl radicals of 8 to 12 carbon atoms are preferred, especially the octyl and nonyl radicals.

The acid radical X is derived from, for example, low molecular dicarboxylic acids such as maleic acid, malonic acid, succinic acid or sulfosuccinic acid, and is linked via an ester bridge to the ethyleneoxy moiety of the molecule. In particular, however, X is derived from inorganic polybasic acids such as orthophosphoric acid and, preferably, sulfuric acid. The acid radical X is preferably in salt form, i.e. for example as alkali metal salt, alkaline earth metal salt, ammonium salt or amine salt. Exemplary of such salts are lithium, sodium, potassium, ammonium, trimethylamine, ethanolamine, diethanolamine or triethanolamine salts.

The fatty alcohols for preparing component (I) of formula (8) are typically those containing 8 to 22, preferably 8 to 18, carbon atoms, and are, for example, octyl, decyl, lauryl, tridecyl, myristyl, cetyl, stearyl, oleyl, arachidyl or behenyl alcohol.

Ester formation is normally effected with the same acids as have been cited for compounds of formula (7).

A preferred compound of formula (8) is the sodium salt of lauryl triglycol ether sulfonic acid.

The following compounds are cited in particular for component (I) of formulae (4) and (5):

1. the ammonium salt of the sulfated polyadduct of 2 mol of ethylene oxide with 1 mol of p-tert.nonylphenol;
2. the sodium salt of the monomaleate of the polyadduct of 2 mol of ethylene oxide with 1 mol of p-nonylphenol;
3. the ammonium salt of the sulfated polyadduct of 3 mol of ethylene oxide with 1 mol of p-butylphenol;
4. the ammonium salt of the phosphated polyadduct of 2 mol of ethylene oxide with 1 mol of p-nonylphenol;
5. the sodium salt of the disulfosuccinate of the polyadduct of 4 mol of ethylene oxide with 1 mol of n-octylphenol;
6. the ammonium salt of the sulfated polyadduct of 9 mol of ethylene oxide with 1 mol of p-nonylphenol;
7. the ammonium salt of the sulfated polyadduct of 6 mol of ethylene oxide with 1 mol of p-nonylphenol;
8. the sodium salt of the monosulfosuccinate of the polyadduct of 2 mol of ethylene oxide with 1 mol of p-nonylphenol;
9. the ammonium salt of the sulfated polyadduct of 6 mol of ethylene oxide with 1 mol of dodecylphenol;
10. the ammonium salt of the sulfated polyadduct of 2 mol of ethylene oxide with 1 mol of octylphenol;
11. the ammonium salt of the sulfated polyadduct of 2 mol of ethylene oxide with 1 mol of Alfol (1014);
12. the ammonium salt of the sulfated polyadduct of 2 mol of ethylene oxide with 1 mol of stearyl alcohol;
13. the ammonium salt of the sulfated polyadduct of 3 mol of ethylene oxide with 1 mol of 2-ethylhexanol;
14. the ammonium salt of the sulfated polyadduct of 15 mol ethylene oxide with 1 mol of stearyl alcohol;
15. the ammonium salt of the sulfated polyadduct of 3 mol of ethylene oxide with 1 mol of tridecyl alcohol;
16. the ammonium salt of the sulfated polyadduct of 4 mol of ethylene oxide with 1 mol of hydroabietyl alcohol;
17. the ammonium salt of the sulfated polyadduct of 3 mol of ethylene oxide with 1 mol of Alfol (2022);
18. the ammonium salt of the sulfated polyadduct of 3 mol of ethylene oxide with 1 mol of lauryl alcohol;
19. the bis($\beta$-hydroxyethyl)amine salt of the sulfated polyadduct of 3 mol of ethylene oxide with 1 mol of lauryl alcohol;
20. the sodium salt of the sulfated polyadduct of 2 mol of ethylene oxide with 1 mol of lauryl alcohol;
21. the sodium salt of the sulfated polyadduct of 3 mol of ethylene oxide with 1 mol of lauryl alcohol;
22. the phosphated polyadduct of 5 mol of ethylene oxide with 1 mol of 2-ethyl-n-hexanol;
23. the ammonium salt of the sulfated polyadduct of 3 mol of ethylene oxide with 1 mol of a mixture of alcohols containing 20 to 22 carbon atoms;
24. the diphosphate of the polyadduct of the 8 mol of ethylene oxide with 1 mol of dodecylamine;
25. the ammonium salt of the phosphated polyadduct of 8 mol of ethylene oxide with 1 mol of tallow fatty amine.

The alkylphenyl sulfonates of component (II) are normally alkali metal salts of corresponding monosulfonic acids containing 8 to 18 carbon atoms in the alkyl moiety, which may be straight-chain or branched and saturated or unsaturated. Suitable alkyl radicals are, typically, n-octyl, tert-octyl, n-nonyl, tert-nonyl, n-decyl, n-dodecyl, tridecyl, myristyl, cetyl, stearyl or oleyl. Alkyl radicals of 8 to 12 carbon atoms are preferred and dodecylbenzenesulfonate (sodium salt) is particularly preferred.

Components (I) and (II) may be used alone or in admixture with each other.

The nonionic surfactants of component (b) are conveniently nonionic polyadducts of 1 to 100 mol of alkylene oxide, for example ethylene oxide and/or propylene oxide, with 1 mol of an aliphatic monoalcohol containing at least 4 carbon atoms, of a trihydric to hexahydric aliphatic alcohol, of an unsubstituted or of an alkyl- or phenyl-substituted phenol or of a fatty acid containing 8 to 22 carbon atoms.

The aliphatic monoalcohols for obtaining the nonionic surfactants are, for example, water-soluble monoalcohols containing at least 4, preferably 8 to 22, carbon atoms. These alcohols may be saturated or unsaturated and straight-chain or branched, and they may be used singly or in admixture. A natural alcohol such as myristyl alcohol, cetyl alcohol, stearyl alcohol or oleyl alcohol, or a synthetic alcohol, preferably 2-ethylhexanol and also trimethylhexanol, trimethylnonyl alcohol, hexadecyl alcohol or a fatty alcohol, may be reacted with the alkylene oxide.

Further aliphatic alcohols which may be reacted with the alkylene oxide are trihydric to hexahydric alkanols. These alcohols contain 3 to 6 carbon atoms and are preferably glycerol, trimethylolpropane, erythritol, mannitol, pentaerythritol and sorbitol. The trihydric to hexahydric alcohols are preferably reacted with propylene oxide or ethylene oxide or with mixtures thereof.

Illustrative examples of unsubstituted or substituted phenols are phenol, o-phenylphenol or alkylphenols which contain 1 to 16, preferably 4 to 12, carbon atoms in the alkyl moiety. Exemplary of these alkylphenols are p-cresol, butylphenol, tributylphenol, octylphenol and, preferably, nonylphenol.

The fatty acids preferably contain 8 to 12 carbon atoms and may be saturated or unsaturated. Typical examples of such fatty acids are capric, lauric, myristic, palmitic or stearic acid, and decenoic, dodecenoic, tetradecenoic, hexadecenoic, oleic, linoleic, linolenic or, preferably, ricinolic acid.

Illustrative examples of nonionic surfactants suitable for use as component (b) are:

polyadducts of preferably 5 to 80 mol of alkylene oxides, preferably ethylene oxide, in which individual ethylene oxide units may be replaced by substituted epoxides such as styrene oxide and/or propylene oxide, with higher unsaturated or unsaturated fatty alcohols, fatty acids, fatty amines or fatty amides containing 8 to 22 carbon atoms or with phenylphenol or alkylphenols, whose alkyl moieties contain at least 4 carbon atoms;

alkylene oxide condensates, preferably ethylene oxide and/or propylene oxide condensates reaction products of a fatty acid containing 8 to 22 carbon atoms and a primary or secondary amine having at least one hydroxy-lower alkyl or lower alkoxy-lower alkyl group, or polyadducts of alkylene oxide with these hydroxyalkylated reaction products, the reaction taking place such that the molecular ratio of hydroxyalkylamine to fatty acid may be 1:1 and greater than 1, for example 1.1:1 to 2:1, and polyadducts of propylene oxide with a trihydric to hexahydric aliphatic alcohol of 3 to 5 carbon atoms, for example glycerol or pentaerythritol, said polypropylene oxide polyadducts having an average molecular weight of 250 to 1800, preferably 400 to 900.

Nonionic surfactants very suitable for use as component (b) are:

(IV) polyadducts of 2 to 15 mol of ethylene oxide with 1 mol of a fatty alcohol or fatty acid, each containing 8 to 22 carbon atoms, or with 1 mol of alkylphenol containing a total of 4 to 12 carbon atoms in the alkyl moiety, (V) fatty alcohols or mono-, di- or triethoxylated fatty alcohols containing 8 to 22 carbon atoms in the fatty alcohol radical, or (VI) fatty acid diethanolamides containing 8 to 22 carbon atoms in the fatty acid radical.

Component (IV) is suitably a polyadduct of octylphenol or, preferably, of nonylphenol, with ethylene oxide, which polyadduct contains 2 to 12 ethylene oxide units.

The following compounds may be specifically mentioned: p-octylphenol/2 mol of ethylene oxide, p-nonylphenol/9 mol of ethylene oxide, p-nonylphenol/10 mol of ethylene oxide, p-nonylphenol/11 mol of ethylene oxide.

Further polyadducts of an alkylphenol with ethylene oxide can be derived from, for example, butylphenol or tributylphenol.

Component (IV) may conveniently also be a polyadduct of 2 to 15 mol, preferably 7 to 15 mol, of ethylene oxide with 1 mol of an aliphatic monoalcohol containing 8 to 22 carbon atoms.

The aliphatic monoalcohols may be saturated or unsaturated and used singly or in admixture. Natural alcohols such as lauryl alcohol, myristyl alcohol, cetyl alcohol, stearyl alcohol, oleyl alcohol, or synthetic alcohols, preferably 2-ethylhexanol, and also trimethylhexanol, trimethylnonyl alcohol, hexadecyl alcohol or $C_{12}$–$C_{22}$fatty alcohols, may be reacted with ethylene oxide.

Polyadducts of 2 to 15 mol of ethylene oxide with 1 mol of fatty acid may also be used as component (IV). The fatty acids preferably contain 10 to 20 carbon atoms and may be saturated or unsaturated. Typical examples of such fatty acids are capric, lauric, myristic, palmitic or stearic acid, and decenoic, dodecenoic, tetradecenoic, hexadecenoic, oleic, linoleic, or ricinolic acid.

Component (V) is a fatty alcohol or an ethoxylated fatty alcohol as defined herein having a HLB value of preferably 0.1 to 10, most preferably of 0.5 to 10. Components (V) having HLB values in the range from 0.1 to 7.0 have been found to be particularly useful. The HLB value is an indication of the hydrophilic/lipophilic balance in a molecule. The HLB values can be determined experimentally or computed in accordance with W. C. Griffin, ISCC 5, 249 (1954) or J. T. Davis, Tenside Detergens 11 (3), 133 (1974).

The fatty alcohols suitable for use as component (V) may be saturated or unsaturated. They preferably contain 12 to 18 carbon atoms. Illustrative examples of such alcohols suitable for use as component (V) are: lauryl, myristyl, cetyl, stearyl, oleyl, arachidyl, behenyl alcohol or $C_{12}$–$C_{22}$fatty alcohols.

These fatty alcohols may conveniently be mono-, di- or triethoxylated.

Preferred components (V) are cetyl alcohol or diethylene glycol cetyl ether (=polyoxyethylene-(2)-cetyl ether) of formula $C_{16}H_{33}$—O—$(CH_2CH_2O)_2$—H.

The fatty acid alkanolamine reaction products of component (VI) are typically products which are prepared from fatty acids of 8 to 22, preferably 8 to 18, carbon atoms, and alkanolamines of 2 to 6 carbons such as ethanolamine, diethanolamine, isopropanolamine or diisopropanolamine. Diethanolamine is preferred. Fatty acid diethanolamines containing 8 to 18 carbon atoms are especially preferred.

Exemplary of suitable fatty acids are caprylic, capric, lauric, myristic, palmitic, stearic, arachidic, behenic, oleic, linoleic, linolenic, arachidonic or coconut fatty acid.

Preferred examples of such reaction products are coconut fatty acid diethanolamide and lauric acid or stearic acid diethanolamide.

Further very suitable nonionic surfactants are alkylene oxide polyadducts of formula $$R'-O-(CH_2CH_2-O)_{n_1}-(\underset{\underset{Z_1}{|}}{CH}-\underset{\underset{Z_2}{|}}{CH}-O)_y-(CH_2CH_2O)_{n_2}-H \quad (9)$$

wherein R′ is hydrogen, alkyl or alkenyl of at most 18 carbon atoms, preferably of 8 to 16 carbon atoms, o-phenylphenyl or alkylphenyl containing 4 to 12 carbon atoms in the alkyl moiety, one of $Z_1$ and $Z_2$ is hydrogen and the other is methyl, y is 1 to 15, and the sum of $n_1+n_2$ is 3 to 15.

Particularly useful nonionic surfactants are fatty alcohol polyglycol mixed ethers, preferably adducts of 3 to 10 mol of ethylene oxide and 3 to 10 mol of propylene oxide with aliphatic monoalcohols of 8 to 16 carbon atoms.

The following polyadducts are exemplary of alkylene oxide polyadducts of formula (9):

a1. polyadduct of 12 mol of ethylene oxide and 12 mol of propylene oxide with 1 mol of a $C_4$–$C_{18}$fatty alcohol, a2. polyadduct of 5 mol of ethylene oxide and 5 mol of propylene oxide with 1 mol of a $C_{12}$–$C_{14}$fatty alcohol, a3. polyadduct of 9 mol of ethylene oxide and 7 mol of propylene oxide with 1 mol of a $C_{16}$–$C_{18}$fatty alcohol, a4. polyadduct of 9.5 mol of ethylene oxide and 9.5 mol of propylene oxide with 1 mol of nonylphenol.

For component (b) it is preferred to use a combination of components (I), (II), (III), (IV), (V) and (VI). The composition of this invention preferably contains, as component (a), a non-dyeing copper complex of bisazomethines, acylhydrazones, semicarbazones or thiosemicarbazones of aromatic aldehydes or ketones or oximes and, as component (b), a combination of components (I), (II), (III), (IV), (V) and (VI).

The composition of this invention most preferably contains, as component (a), a copper complex of formula (2), and, as component b), a combination of components (I), (II), (III), (IV), (V) and (VI).

Particularly preferred mixtures of component (b) are, typically, those of (1) nonylphenol/ethylene oxide polyadducts containing 10 to 12 ethylene oxide units, sodium salts of sulfated fatty alcohol ethylene oxide polyadducts containing 8 to 12 carbon atoms in the alcohol moiety and 2 to 4 ethylene oxide units and coconut fatty acid diethanolamide, (2) reaction products of 7 to 15 mol of ethylene oxide with 1 mol of stearyl alcohol, coconut fatty acid diethanolamide and cetyl alcohol or diethoxylated cetyl alcohol, or (3) dodecylbenzenesulfonate, sodium lauryl triglycol ether sulfate, coconut fatty acid diethanolamide and the disodium salt of 1-benzyl-2-stearylbenzimidazoledisulfonic acid.

Particularly preferred are mixtures of a sulfated polyadduct of a fatty alcohol and ethylene oxide containing 8 to 18 carbon atoms in the alcohol moiety and 2 to 4 ethylene oxide units, or the alkali metal salt thereof, and a fatty acid diethanolamide containing 8 to 18 carbon atoms in the fatty acid moiety.

A mixture of sodium lauryl triglycol ether sulfate and fatty acid diethanolamine is particularly preferred.

The compounds of component (b) are very good foaming agents, i.e. they are able on the one hand to form the foam to a sufficient degree when used in small amounts and, on the other, also to stabilise the foam.

The optional component (c) of the composition of this invention is hydrolysed polymaleic anhydride, which suitably has a molecular weight of 300 to 5000 and is at least partially in the form of a water-soluble salt of such a polymaleic anhydride. Polymers of this kind are suitable chelating agents for binding contaminants present in the fibre material, for example calcium and/or magnesium salts.

Polymaleic anhydride is a homopolymer of maleic anhydride and can be very readily hydrolysed, for example by heating with water, to form a polymeric product. The product does not constitute a pure polymaleic acid. The exact constitution of the product is not known. Hence within the scope of this invention, this polymeric product formed by hydrolysis of polymaleic anhydride will be referred to as hydrolysed polymaleic anhydride. This hydrolysed polymaleic anhydride can be prepared from a polymer by addition polymerisation of a starting monomer consisting essentially of maleic anhydride under polymerisation conditions in the melt or by solution polymerisation. It is preferred to polymerise maleic anhydride in an inert organic solvent such as toluene or xylene, in the presence of a polymerisation catalyst, preferably of a radical initiator such as benzoyl peroxide, di-tertiary butyl peroxide or monobutyl peroxide, in the temperature range up to 150° C., for example in the range from 120° to 145° C. The main chain of the primary polymer is formed essentially by non-hydrolysable bonds. After being freed from unreacted monomer and other nonpolymeric constituents, the primary non-hydrolysed polymer product is then hydrolysed with water or a water-soluble alkali and so used. In some cases, it can also be added in non-hydrolysed form to the aqueous treatment baths.

During the polymerisation or after the subsequent hydrolysis, a decarboxylation of the polymer may occur, so that the acid number found of the hydrolysed polymaleic anhydride is lower than the theoretical value of 1143 mg KOH/g. Such a decarboxylation, however, does not take place to such an extent that the acid number falls below 350 mg KOH/g. The acid number can be determined by potentiometric titration in aqueous solution against 0.1N potassium hydroxide solution, plotting $\Delta pH:\Delta V$ graphically and taking the highest peak as the end point. $\Delta pH$ represents the change in pH, $\Delta V$ the change in volume, and V the titrated volume.

It is important that the molecular weight of the hydrolysed polymaleic anhydride should lie in the indicated low range. It is preferred to use polymaleic anhydride having a molecular weight which does not exceed 2000 and which is preferably in the range from 350 to 1000.

The molecular weight of the polymaleic anhydride is normally calculated from the osmometric data of the polymaleic anhydride before the hydrolysis.

Further particulars on the nature of the hydrolysed polymaleic anhydride and the preparation thereof are disclosed in British patent specifications 1 369 429, 1 411 063 and 1 491 978, and in Swiss patent specification 624 256.

By addition of bases to the hydrolysed polymaleic anhydride, the carboxyl groups are in the form of water-soluble salt groups when using medium-strong to strong bases. When using weak bases, only some of the carboxyl groups are in the form of water-soluble salts. Exemplary of salt groups are alkali metal salts, alkylammonium salts, alkanolammonium salts or ammonium salts. Alkali metal salts are in particular the sodium or potassium salt, and alkylammonium or alkanolammonium salts are the trimethylammonium, monoethanolammonium, diethanolammonium or triethanolammonium salt. The sodium or ammonium salt is preferred.

As component (c), the salt of hydrolysed polymaleic anhydride of the indicated kind is normally in the form of an aqueous solution of ca. 40–60% by weight.

Suitable polar organic solvents for optional component (d) of the process of this invention are solvents which are preferably soluble in water in any ratio. Component (d) serves to improve the solubility of the individual components. Illustrative examples of water-soluble organic solvents are aliphatic $C_1$–$C_4$alcohols such as methanol, ethanol or the propanols; alkylene glycols such as ethylene glycol or propylene glycol; monoalkyl ethers of glycols such as ethylene glycol monomethyl, monoethyl or monobutyl ether, and diethylene glycol monomethyl or monoethyl ether; ketones such as acetone, methyl ethyl ketone, cyclohexanone, diacetone alcohol; ethers and acetals such as diisopropyl ether, diphenyl oxide, dioxane, tetrahydrofuran, and also tetrahydrofurfuryl alcohol, pyridine, acetonitrile, γ-butyrolactone, N,N-dimethylformamide, N,N-dimethylacetamide, tetramethylurea and tetramethylenesulfone. Mixtures of the cited solvents may also be used. Preferred solvents are the cited alcohols, monoalkyl ethers of the glycols and ketones of the indicated kind, especially the ethylene glycols such as ethylene glycol and, preferably, propylene glycol, as well as diacetone alcohol.

Dyeing is carried out in conventional manner, for example with metal complex dyes or also with anthraquinone dyes or azo dyes. The metal complex dyes used are the known types, especially the 1:2 chromium or 1:2 cobalt complexes of monoazo or disazo or azomethine dyes which are copiously described in the literature. In addition to these dyes, it is of course also possible to use dyes of other classes, for example disperse dyes or also vat dyes.

The foam forming compositions can also be used for fibre materials which have been whitened with fluorescent whitening agents. Depending on the substrate, anionic or cationic as well as water-dispersible fluorescent whitening agents are used. The fluorescent whitening agents may belong to the coumarin, oxazine, naphthalimide, stilbene, styrile, pyrazine, pyrazoline, triazolyl, benzofuranyl, benzoxazolyl, bis(benzoxazolyl), thiophenebis(benzoxazolyl) or benzimidazolyl series.

The foamed aqueous composition can be prepared by simple stirring of the individual components (a), (b) and additional optional components (c) and (d) in water.

The foamed aqueous composition conveniently comprises, based on said composition, 2 to 20 percent by weight, preferably 6 to 14 percent by weight of component (a), 0.5 to 10 percent by weight, preferably 1 to 4 percent by weight of component (b), 0 to 2 percent by weight, preferably 0 to 1 percent by weight of component (c), 0 to 5 percent by weight, preferably 0 to 1.5 percent by weight of component (d), and water to make up 100%.

The amounts in which the foamed composition is added to the treatment liquor range from 1 to 30 g, preferably from 4 to 20 g, per liter of treatment liquor, depending on the dyeing or finishing process. In these amounts, the copper content per g of polyamide fibre material is from 5 to 200 μg.

Polyamide material will be understood as meaning synthetic polyamide such as polyamide 6, polyamide 66 or polyamide 12. In addition to pure polyamide fibres, blends of polyurethane and polyamide are also suitable, for example polyamide/polyurethane blends in the ratio of 70:30. In principle, the pure or blended material can be in any form of presentation, for example fibres, yarn, woven fabrics, pile fabrics or knitted goods.

Pile fabrics made from polyamide or polyamide/polyurethane blends are preferred.

The process of this invention is especially suitable for treating polyamide material which is exposed to the action of light and heat and is used as car upholstery or carpeting.

The aftertreatment and dye liquors can also contain conventional auxiliaries, suitably electrolytes such as salts, for example sodium sulfate, ammonium sulfate, sodium or ammonium phosphates or polyphosphates, ammonium acetate or sodium acetate and/or acids such as mineral acids, for example sulfuric acid or phosphoric acid, or organic acids, preferably lower aliphatic carboxylic acids such as formic acid, acetic acid or oxalic acid. The acids are added in particular to adjust the pH of the liquors of this invention.

Depending on the substrate to be treated, the pH is generally in the range from 4 to 8.

Depending on the desired effect, the aftertreatment and dye liquors additionally contain further auxiliaries or modifiers such as catalysts, ureas, oxidising agents, retardants, dispersants, stabilisers or emulsifiers.

The aqueous composition for carrying out the process also constitutes an object of the present invention. The composition comprises (a) a non-dyeing copper complex of bisazomethines, acylhydrazones, semicarbazones or thiosemicarbazones of aromatic aldehydes or ketones or oximes
(b) an anionic or nonionic surfactant or a mixture of said surfactants, and, as optional components,
(c) a salt of a hydrolysed polymaleic anhydride, and
(d) a polar organic solvent.

A preferred embodiment of the composition of the invention comprises (a) a copper complex of formula (2),
(b) a mixture of a sulfated polyadduct of a fatty alcohol with ethylene oxide containing 8 to 18 carbon atoms in the alcohol moiety and 2 to 4 ethylene oxide units, or the alkali metal salt thereof, and, as optional components,
(c) the sodium or ammonium salt of a hydrolysed polymaleic anhydride having a molecular weight of 300 to 500, and
(d) ethylene or propylene glycol and diacetone alcohol.

The foams are preferably produced by mechanical means using impellers, dynamic or static mixers or also special foam pumps, with which latter the foams can also be produced continuously. In the process of this invention, blow ratios, i.e. volume ratios of foamed to unfoamed composition, of 1:6 to 1:12, preferably 1:8 to 1:10, have been found suitable.

The foams used in the practice of this invention are stable over a considerable period of time and do not collapse immediately when applied to the substrate. The foams used in the practice of this invention preferably have half-lives of 2 to 10 minutes. The bubbles in the foams have diameters from ca. 1 to 100μ.

The foams can be applied uniformly to the fibre materials by a wide variety of techniques. Exemplary of some techniques are: vacuum penetration, rolling on, rolling on/suction, doctor coating with fixed blades or roll coating (on one or both sides), padding, blowing in, compressing, passing the textile substrate through a chamber which is continuously charged with and in which foam is under a certain pressure. These procedures cause the foam to collapse, i.e. the foam decomposes and wets the textile material.

The application of the foam is normally made at room temperature, i.e., in the temperature range from 15° to 30° C. The add-on of foam is normally 10 to 100 percent by weight, preferably 30 to 80 percent by weight, based on the treated material.

For the photochemical stabilisation of the dyed textiles, a treatment liquor is foamed and the foam is applied continuously by means of an applicator roll to the face of the fabric from a foam container, preferably with adjustable doctor blade. If desired, the application, of foam can be repeated on the back of the fabric. When applying foam to the face and back of the fabric, it is not necessary to effect an intermediate drying between the applications to the face and to the back. It is also possible to apply different treatment liquors to the face and to the back of the fabric.

Another means of applying the foam consists in padding the substrate with a padding liquor containing the foamed composition. Impregnation is preferably made to a liquor pick-up of 40 to 100 percent by weight.

After the foam application, the textile material is dried in the temperature range from 100° to 160° C.

In the following Examples, percentages are by weight, unless otherwise stated.

EXAMPLE 1

5 carpet samples having a weight of 500 g/m$^2$ are prepared. The carpets are wetted on a winchbeck for 5 minutes at 20° C. in an aqueous liquor which contains, per liter, 2% of a nonionic levelling agent based on alkylamine polyglycol ether. The pH is 7. To the liquor is then added the following combination of dyes:

0.22% of the dye of formula

-continued (101)

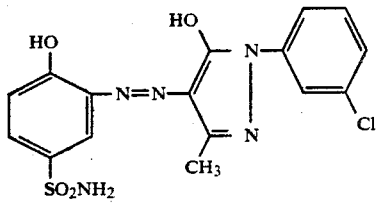

(1:2 Co complex)

0.014% of the dye formula (102)

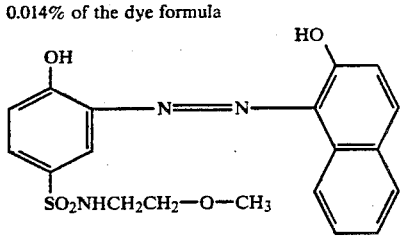

and 0.095% of a mixtures of dyes of formulae (103a)

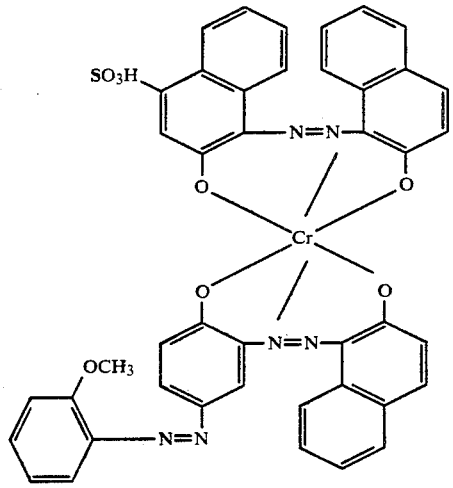

(103b)

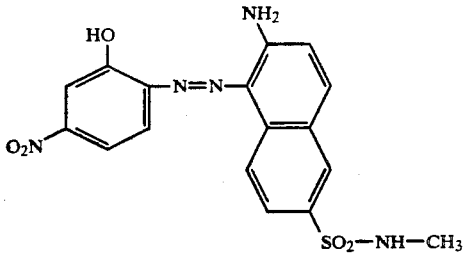

and (103c)

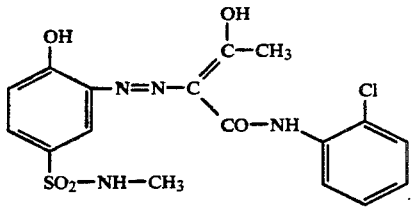

After addition of the dye combination, treatment is continued for 5 minutes at the same temperature. The temperature is then raised over 45 minutes to 98° C. and dyeing is continued for 45 minutes at this temperature.

The samples are removed from the dyebath and rinsed with cold water.

A foam is prepared in a foaming appartus from a liquor comprising a)

1 g/l of a composition consisting of
2.0% of 50% NaOH
5.0% of a 50% aqueous polymaleic acid
15.0% of coconut fatty acid diethanolamide
25.0% lauryl triglycol ether sulfate
9.0% of diacetone alcohol and
44% of water as well as b)

16 g/l of a composition consisting of
10.0% of the copper complex of formula (104)

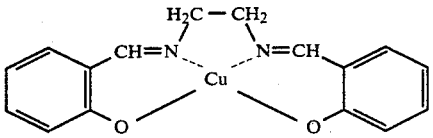

4.3% of sodium sulfate
2.5% of an ethylene oxide/propylene oxide block polymer
10% of Mg-Al silicate
0.75% of 1,2-propylene glycol
0.3% of a polysaccharide and
81.15% of water.

The foam has a blow ratio of 1:9 and a half-life of 5 minutes.

The individual carpet samples are treated as follows:

Sample 1: The carpet is treated at 140° C. after dyeing. No aftertreatment is carried out.

Sample 2: The carpet sample is impregnated on a pad with the foaming liquor to a pick-up of 50% and then dried at 140° C.

Sample 3: The foam is applied continuously with a coating knife for adjusting the desired foam thickness to the pile side of the carpet via an applicator roll using a carriage. The pick-up is 50%. The running speed is 12 m/min. The height of the foam is 10 mm. The foam add-on is 50%. The carpet is subsequently dried at 140° C.

Sample 4: The procedure is carried as for sample 3, except that the pick-up is 100%.

EXAMPLES 2–4

In these examples the concentration of the copper complex compound of formula (104) is varied.

EXAMPLE 2

A carpet sample (=sample 5) having a weight of 500 g/m$^2$ is wetted, dyed and rinsed with cold water as described in Example 1. The sample is aftertreated as described for sample 2, except that 12 g/l of composition b) is used.

EXAMPLE 3

The procedure of Example 2 is repeated, except that 8 g/l of composition b) is used (=sample 6).

EXAMPLE 4

The procedure of Example 2 is repeated, except that 4 g/l of the compound of composition b) is used (=sample 7).

The lightfastness of the dyed and aftertreated carpet samples is determined in accordance with DIN 75.202 (FAKRA). The results are reported in Table 1.

TABLE 1

| | Exposure: DIN 75 202 (FAKRA) | | |
|---|---|---|---|
| | 1 × Fakra (=72 h) | 2 × Fakra (=144 h) | 3 × Fakra (=216 h) |
| sample 1 | 4–5 | 3H+ | 2H |
| sample 2 | 5 | −5 | 4–5 |
| sample 3 | 5 | 5 | −5 |
| sample 4 | 5 | 5 | −5 |
| sample 5 | 4–5 | 4 | +3–4 |
| sample 6 | 4–5 | 4 | 3–4 |
| sample 7 | 4–5 | 4 | −3–4 |

The results show that the lightfastness properties of the dyeings which are treated with the composition of the invention are markedly better than comparison dyeings without aftertreatment (sample 1).

What is claimed is:

1. A process for the photochemical stabilisation of dyed polyamide fibre materials, which comprises treating the dyed material with a foamed aqueous composition which contains at least (a) a non-dyeing copper complex of bisazomethines, acylhydrazones, semicarbazones or thiosemicarbazones of aromatic aldehydes or ketones or oximes.

2. A process according to claim 1, wherein component (a) is a compound of formula

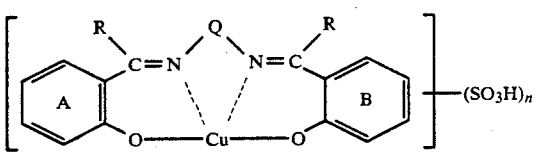

(1)

in which R is hydrogen or a substituted or unsubstituted alkyl or aryl radical, Q is a substituted or unsubstituted alkylene, cycloalkylene or arylene radical and n is 0, 1, 2 or 3.

3. A process according to claim 2, wherein component (a) is a bisazomethine complex of formula

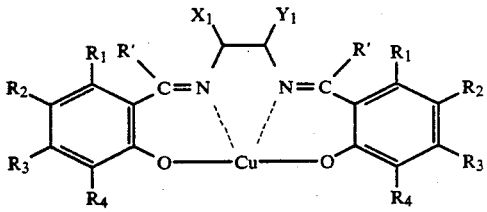

(2)

in which R' is hydrogen, $R_1$, $R_2$, $R_3$ and $R_4$ are each hydrogen, halogen, hydroxyl, hydroxyalkyl, alkyl, alkoxy, alkoxyalkoxy, alkoxyalkoxyalkoxy, carboxymethoxy, alkylamino, dialkylamino, $-SO_2NH_2$, $-SO_2NHR_0$ or $-SO_2N(R_0)_2$, $R_0$ being alkyl or alkoxyalkyl, and alkyl or alkoxy each being understood as groups having 1–4 carbon atoms, or $R_1$ and $R_2$ or $R_2$ and $R_3$ or $R_3$ and $R_4$, together with the carbon atoms to which they are linked, form a benzene radical, and $X_1$ and $Y_1$ are hydrogen, $C_1$–$C_4$alkyl or an aromatic radical or $X_1$ and $Y_1$ form together with the carbon atom to which they are linked a cycloaliphatic radical of 5–7 carbon atoms.

4. A process according to claim 3, wherein component (a) is copper complex compound of the formula

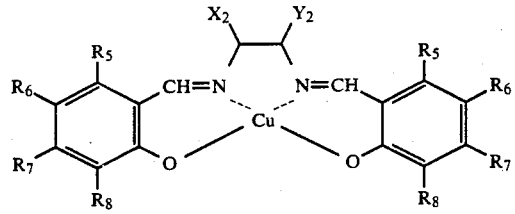

(3)

wherein $R_5$–$R_8$ are each and independently from each other hydrogen, hydroxyl, chlorine, bromine methyl, tert.butyl, methoxy, methoxyethoxy, ethoxyethoxyethoxy or diethylamino, $X_2$ hydrogen, methyl, ethyl or phenyl and $Y_2$ hydrogen or $R_5$ and $R_6$ together form a fused benzene ring or $X_2$ and $Y_2$ together form a cyclohexylene radical.

5. A process according to claim 4, wherein component (a) is copper complex compound of the formula

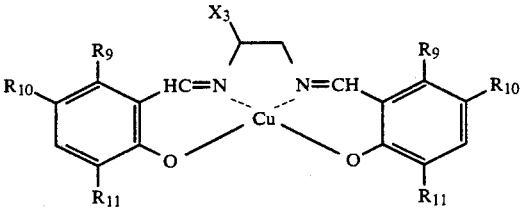

(4)

wherein $R_9$, $R_{10}$ and $R_{11}$ are each independently of one another hydrogen, chloro, bromo, methyl or methoxy, or wherein $R_9$ and $R_{10}$ together form a fused benzene ring, and $X_3$ is hydrogen, methyl, ethyl or phenyl.

6. A process according to claim 5, wherein component (a) is a compound of formula (4), wherein $R_9$, $R_{10}$, $R_{11}$ and $X_3$ are hydrogen.

7. A process according to claim 1, wherein component (a) is a copper complex of the formula

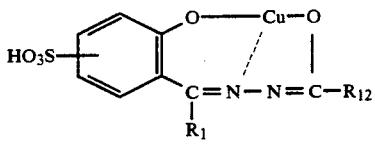

(5)

in which $R_1$ and $R_{12}$ independently of one another are hydrogen or a substituted or unsubstituted alkyl or aryl radical.

8. A process according to claim 1, wherein component (a) is a copper complex of the formula

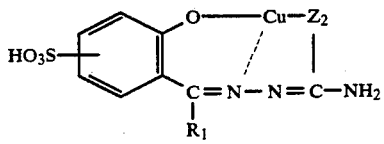

(5a)

in which $R_1$ is as defined under the formula (5) and $Z_2$ is oxygen or sulfur.

9. A process according to claim 1, wherein component (a) is a copper complex of the formula

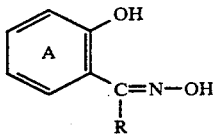

(6)

wherein R is hydrogen, hydroxy, alkyl or cycloalkyl, and in which the ring A is unsubstituted or further substituted.

10. A process according to claim 1, wherein the foamed aqueous composition additionally comprises an anionic or nonionic surfactant, or a mixture thereof, as component (b), and a salt of a hydrolysed polymaleic anhydride as optional component (c), and a polar organic solvent as optional component (d).

11. A process according to claim 10, wherein component (b) is a combination of the components:

(I) acid esters or their salts of a polyadduct of 2 to 15 mol of ethylene oxide with 1 mol of a fatty alcohol containing 8 to 22 carbon atoms or with 1 mol of an alkylphenol containing 4 to 12 carbon atoms in the alkyl moiety, (II) alkylphenylsulfonates containing 8 to 18 carbon atoms in the alkyl moiety, (III) sulfonated 1-benzyl-2-alkylbenzimidazoles containing 8 to 22 carbon atoms in the alkyl moiety, (IV) polyadducts of 2 to 15 mol of ethylene oxide with 1 mol of a fatty alcohol or fatty acid, each containing 8 to 22 carbon atoms, or with 1 mol of alkylphenol containing a total of 4 to 12 carbon atoms in the alkyl moiety, (V) a fatty alcohol or a mono-, di- or triethoxylated fatty alcohol containing 8 to 22 carbon atoms in the fatty alcohol radical, or (VI) a fatty acid diethanolamide containing 8 to 12 carbon atoms in the fatty acid radical.

12. A process according to claim 1, wherein component (a) is a non-dyeing copper complex of bisazomethines, acylhydrazones, semicarbazones or thiosemicarbazones of aromatic aldehydes or ketones or oximes, and component (b) is a combination of components (I), (II), (III), (IV), (V) and (VI).

13. A process according to claim 1, wherein component (a) is a copper complex of formula (2), and component (b) is a combination of components (I), (II), (III), (IV), (V) and (VI).

14. A process according to any one of claim 10, wherein component (b) is a mixture of a sulfated polyadduct of a fatty alcohol and ethylene oxide containing 8 to 18 carbon atoms in the alcohol moiety and 2 to 4 ethylene oxide units, or the alkali metali salt thereof, and a fatty acid diethanolamide containing 8 to 18 carbon atoms in the fatty acid radical.

15. A process according to claim 10, wherein component (b) is a mixture of sodium lauryl triglycol ether sulfate and a fatty acid diethanolamine containing 8 to 18 carbon atoms in the fatty acid radical.

16. A process according to claim 10, wherein optional component (c) is a sodium or ammonium salt of a hydrolysed polymaleic anhydride having a molecular weight of 300 to 5000.

17. A process according to claim 10, wherein optional component (d) is ethylene or propylene glycol and diacetone alcohol.

18. A process according to claim 1, wherein the foamed aqueous composition comprises 2 to 20 percent by weight of component (a),
0.5 to 10 percent by weight of component (b),
0 to 2 percent by weight of component (c),
0 to 5 percent by weight of component (d), and
water to make up 100%.

19. A process according to claim 1, wherein the blow ratio is 1:6 bis 1:12.

20. A process according to claim 1, which comprises applying the foamed treatment liquor continuously via an applicator roll to the dyed textile material and drying the treated material after possible decomposition of the foam.

21. A process according to claim 1, which comprises padding the dyed textile material with the treatment liquor.

22. An aqueous composition comprising (a) a non-dyeing copper complex of bisazomethines, acylhydrazones, semicarbazones or thiosemicarbazones of aromatic aldehydes or ketones or oximes (b) an anionic or nonionic surfactant or a mixture of said surfactants, and, as optional components, (c) a salt of a hydrolysed polymaleic anhydride, and (d) a polar organic solvent.

23. A composition according to claim 22, which comprises (a) a copper complex of formula (2), (b) a mixture of a sulfated polyadduct of a fatty alcohol with ethylene oxide containing 8 to 18 carbon atoms in the alcohol moiety and 2 to 4 ethylene oxide units, or the alkali metal salt thereof, and, as optional components, (c) the sodium or ammonium salt of a hydrolysed polymaleic anhydride having a molecular weight of 300 to 5000, and (d) ethylene or propylene glycol and diacetone alcohol.

24. Dyed polyamide textile material which is photochemically stabilised by a process as claimed in claim 1.

* * * * *